US010033103B2

(12) United States Patent
Ito

(10) Patent No.: US 10,033,103 B2
(45) Date of Patent: Jul. 24, 2018

(54) MULTILAYER COIL DEVICE, ANTENNA MODULE, AND WIRELESS COMMUNICATION MODULE

(71) Applicant: Murata Manufacturing Co., Ltd., Nagaokakyo-shi, Kyoto-fu (JP)

(72) Inventor: Hiromitsu Ito, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 210 days.

(21) Appl. No.: 15/235,286

(22) Filed: Aug. 12, 2016

(65) Prior Publication Data

US 2016/0352016 A1 Dec. 1, 2016

Related U.S. Application Data

(63) Continuation of application No. PCT/JP2015/054934, filed on Feb. 23, 2015.

(30) Foreign Application Priority Data

Feb. 27, 2014 (JP) ..... 2014-036817

(51) Int. Cl.
*H01Q 7/06* (2006.01)
*H01Q 7/00* (2006.01)
(Continued)

(52) U.S. Cl.
CPC ..... *H01Q 7/06* (2013.01); *H01F 17/0013* (2013.01); *H01F 17/0033* (2013.01);
(Continued)

(58) Field of Classification Search
CPC ..... H01Q 7/06; H01Q 1/36; H01Q 27/2804; H01Q 1/241; H01Q 7/00;
(Continued)

(56) References Cited

U.S. PATENT DOCUMENTS 8,143,988 B2 * 3/2012 Hamano ..... H01F 17/0013 336/200
8,354,971 B2 * 1/2013 Ito ..... G06K 19/07749 343/787
(Continued)

FOREIGN PATENT DOCUMENTS

GB 2469209 A 10/2010
JP 9-64634 A 3/1997
(Continued)

OTHER PUBLICATIONS

English translation of Official Communication issued in corresponding International Application PCT/JP2015/054934, dated May 19, 2015.

*Primary Examiner* — Jean B Jeanglaude
(74) *Attorney, Agent, or Firm* — Keating & Bennett, LLP

(57) ABSTRACT

A multilayer coil device includes a multilayer body including first and second coil conductors each having a winding planar shape and a magnetic shield member having a planar shape. Winding regions of the first and second coil conductors partially overlap each other as seen in a direction in which the winding axes extend. The magnetic shield member is between the first and second coil conductors in the direction in which the winding axes extend and overlaps a first region where the first and second coil conductors overlap each other and does not overlap at least a portion of a second region where the first and second coil conductors do not overlap each other.

20 Claims, 15 Drawing Sheets

(51) Int. Cl.

| | |
|---|---|
| ***H01F 17/00*** | (2006.01) |
| ***H01F 27/28*** | (2006.01) |
| ***H01Q 1/24*** | (2006.01) |
| ***H01Q 1/36*** | (2006.01) |

(52) U.S. Cl.
CPC ..... *H01F 27/2804* (2013.01); *H01F 27/2885* (2013.01); *H01Q 1/241* (2013.01); *H01Q 1/36* (2013.01); *H01Q 7/00* (2013.01); *H01F 2017/0066* (2013.01)

(58) Field of Classification Search
CPC ..... H01Q 2017/0066; H01Q 1/24; H01F 27/2885; H01F 17/0033; H01F 17/0013; H01F 17/00; H01F 27/28
USPC ..... 343/878, 702, 788
See application file for complete search history.

(56) References Cited

U.S. PATENT DOCUMENTS

| | | | | |
|---|---|---|---|---|
| 9,225,064 | B2 * | 12/2015 | Gouchi | H01Q 7/06 |
| 2011/0124299 | A1 * | 5/2011 | Koujima | G06K 19/07749 455/73 |
| 2012/0007787 | A1 * | 1/2012 | Schantz | G01S 5/14 343/788 |
| 2013/0127434 | A1 | 5/2013 | Ikriannikov | |
| 2014/0247192 | A1 | 9/2014 | Ikemoto | |
| 2014/0253404 | A1 | 9/2014 | Ikemoto et al. | |
| 2015/0214620 | A1 * | 7/2015 | Yosui | H01Q 7/00 343/702 |
| 2015/0247192 | A1 * | 9/2015 | Frayling | C12Q 1/6869 506/2 |
| 2015/0318602 | A1 * | 11/2015 | Nakano | H01Q 1/521 343/702 |

FOREIGN PATENT DOCUMENTS

| | | | |
|---|---|---|---|
| JP | 2002-280218 | A | 9/2002 |
| JP | 2002-343643 | A | 11/2002 |
| JP | 2007-5498 | A | 1/2007 |
| JP | 2010-109674 | A | 5/2010 |
| JP | 2010-245776 | A | 10/2010 |
| JP | 2012-222961 | A | 11/2012 |
| WO | 2013/114978 | A1 | 8/2013 |
| WO | 2013/115158 | A1 | 8/2013 |

* cited by examiner

MULTILAYER COIL DEVICE, ANTENNA MODULE, AND WIRELESS COMMUNICATION MODULE

CROSS REFERENCE TO RELATED APPLICATIONS

This application claims the benefit of priority to Japanese Patent Application 2014-036817 filed Feb. 27, 2014 and is a Continuation Application of PCT/JP2015/054934 filed on Feb. 23, 2015, the entire contents of each application are hereby incorporated herein by reference.

BACKGROUND OF THE INVENTION

1. Field of the Invention

The present invention relates to a multilayer coil device in which coils including conductive patterns are disposed inside a multilayer body of a lamination of insulating layers and to an antenna module and wireless communication module including the multilayer coil device.

2. Description of the Related Art

Various multilayer electronic components in which circuit elements are formed inside multilayer bodies by forming conductive patterns inside the multilayer bodies have been contemplated. One example is a multilayer electronic component described in Japanese Unexamined Patent Application Publication No. 2002-280218. The multilayer electronic component is configured such that a plurality of coils are incorporated by forming a plurality of conductive patterns in a spiral shape inside the multilayer body.

In the multilayer electronic component described in Japanese Unexamined Patent Application Publication No. 2002-280218, the plurality of coil conductive patterns are disposed on the same layer (same plane). Internal ground conductors are arranged between the plurality of coil conductive patterns. This configuration reduces the coupling between the plurality of coils adjacent to each other in the single multilayer electronic component.

However, in the known multilayer electronic component incorporating the coils described in Japanese Unexamined Patent Application Publication No. 2002-280218, as the area of the multilayer electronic component as seen in plan view, at least the sum of an area of the plurality of coil conductive patterns, the area of internal ground conductors arranged between the plurality of coil conductive patterns, and the area of portions for separating these conductive patterns is needed. Accordingly, it is difficult to decrease the area of the multilayer electronic component as seen in plan view.

SUMMARY OF THE INVENTION

Preferred embodiments of the present invention provide a multilayer coil device capable of including a plurality of coils inside a multilayer body, reducing the coupling between the coils, and having a reduced area as seen in plan view.

A multilayer coil device according to a preferred embodiment of the present invention includes a multilayer body in which a plurality of insulating sheets are laminated, a first coil conductor and a second coil conductor defining a first coil and a second coil, respectively, disposed inside the multilayer body and each having a winding shape, and a magnetic shield member disposed inside the multilayer body and having a two-dimensional shape and has a configuration described below as characteristics. The first coil and the second coil are arranged such that their respective winding axes extend in a same or substantially same direction and their respective winding regions partially overlap each other as seen in the direction in which the winding axes extend. The magnetic shield member has a shape in which it is arranged between the first coil and the second coil in the direction in which the winding axes extend and it overlaps a first region where the first coil and the second coil overlap each other and does not overlap at least a portion of a second region where the first coil and the second coil do not overlap each other, as seen in the direction in which the winding axes extend.

In this configuration, the first coil and second coil partially overlap each other as seen in the direction in which their winding axes extend. Accordingly, the area of the multilayer body is able to be reduced. In addition, by virtue of the shape of the magnetic shield member in which it overlaps the first region where the first coil and second coil overlap each other and does not overlap at least a portion of the second region where the first coil and second coil do not overlap each other, the coupling between the first coil and second coil in the first region is effectively reduced, the overcurrent occurring in the magnetic shield member is reduced, and thus degradation in the characteristics caused by decreases in the Q values of the first coil and second coil resulting from the magnetic shield member are reduced.

In a multilayer coil device according to a preferred embodiment of the present invention, the direction in which the winding axes of the first coil and the second coil extend may preferably be identical or substantially identical with a direction in which the plurality of insulating sheets are laminated.

In this configuration, when the first coil conductor and second coil conductor are disposed on surfaces of different insulating sheets and these insulating sheets are laminated, the structure in which the first coil conductor and second coil conductor partially overlap each other is readily achieved.

A multilayer coil device according to a preferred embodiment of the present invention may preferably have a configuration described below. The multilayer coil device further includes a third coil including a third coil conductor disposed in the multilayer body and having a helical shape. The first coil, the second coil, and the magnetic shield member are arranged inside a region surrounded by the helical shape of the third coil.

In this configuration, the third coil, which is different from the first coil and second coil, is able to be disposed in the multilayer body, while at the same time the increase in the size of the multilayer body is able to be reduced or prevented.

In a multilayer coil device according to a preferred embodiment of the present invention, the winding axes of the first coil and the second coil may preferably be perpendicular or substantially perpendicular to a winding axis of the third coil.

In this configuration, the coupling between the third coil and each of the first coil and second coil is able to be reduced.

In a multilayer coil device according to a preferred embodiment of the present invention, the first coil and the second coil may preferably be arranged in an inward region spaced apart by a predetermined distance from opposite ends of the third coil in a direction in which the winding axis of the third coil extends.

In this configuration, the first coil conductor and second coil conductor are able to be made less likely to be coupled to a magnetic field coupled to the third coil conductor.

A multilayer coil device according to a preferred embodiment of the present invention may preferably have a configuration described below. At least a portion of the insulating sheets defining the multilayer body are magnetic. The first coil and the second coil are arranged between the magnetic insulating sheets.

In this configuration, the magnetic members between which the first coil and second coil are disposed may be used as a magnetic core of the third coil.

A multilayer coil device according to a preferred embodiment of the present invention may preferably have a configuration described below. The multilayer coil device further includes a plurality of via conductors for use in connecting the first coil, the second coil, and the third coil to an external terminal. A direction in which the plurality of via conductors are arranged is parallel or substantially parallel to the direction in which the winding axis of the third coil extends.

In this configuration, the coupling between the plurality of via conductors and the first and second coils is reduced, while at the same time the coupling between the magnetic field to which the third coil is coupled and the plurality of via conductors is reduced.

In a multilayer coil device according to a preferred embodiment of the present invention, the third coil may preferably define a coil antenna, and the first coil and the second coil may preferably define inductors included in a circuit connected to the coil antenna.

In this configuration, a portion of the antenna module is defined by the multilayer coil device, and the antenna module is thus able to be miniaturized.

In a multilayer coil device according to a preferred embodiment of the present invention, the magnetic shield member may preferably have a shape that surrounds only the first region.

In this configuration, the coupling between the first coil and second coil is reduced, and degradation in the characteristics caused by decreases in the Q values of the first coil and second coil resulting from the magnetic shield member are further reduced.

An antenna module according to a preferred embodiment of the present invention includes the above-described multilayer coil device and a wireless IC connected to at least one of the inductors defined by the first coil and the second coil.

In this configuration, the use of the above-described multilayer coil device enables miniaturization of the antenna module.

A wireless communication module according to a preferred embodiment of the present invention includes the above-described multilayer coil device and a wireless IC connected to the inductors defined by the first coil and the second coil. The first coil and the second coil define a filter circuit, and the coil antenna defined by the third coil is connected to the wireless IC with the filter circuit interposed therebetween and defines a radiating element.

In this configuration, the use of the above-described multilayer coil device enables miniaturization of the wireless communication module.

According to various preferred embodiments of the present invention, a multilayer coil device including a plurality of coils disposed inside a multilayer body and reducing coupling between the coils is able to disposed in a small area.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
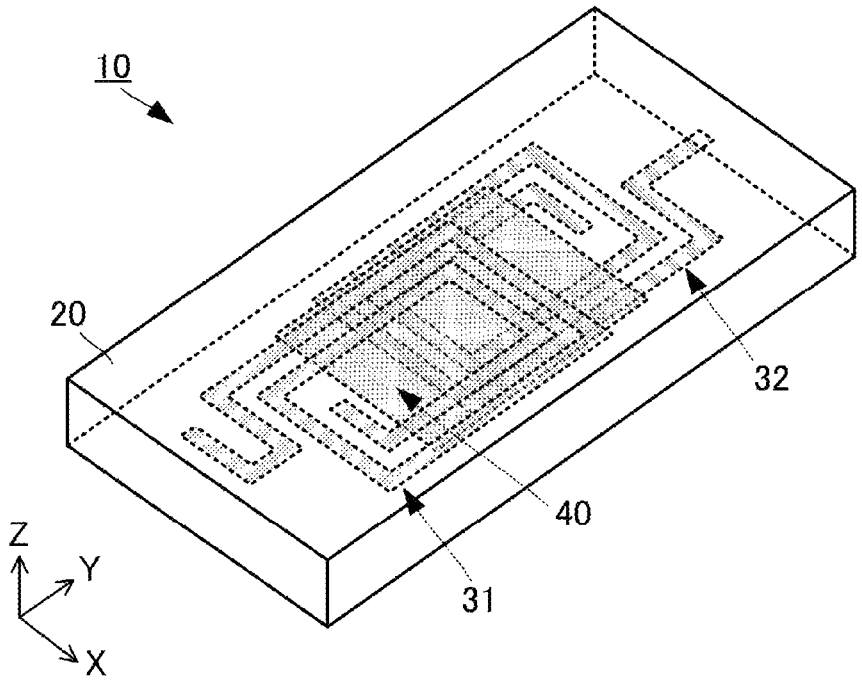
FIG. 1 is an external perspective view of a multilayer coil device according to a first preferred embodiment of the present invention.
Figure 2A:
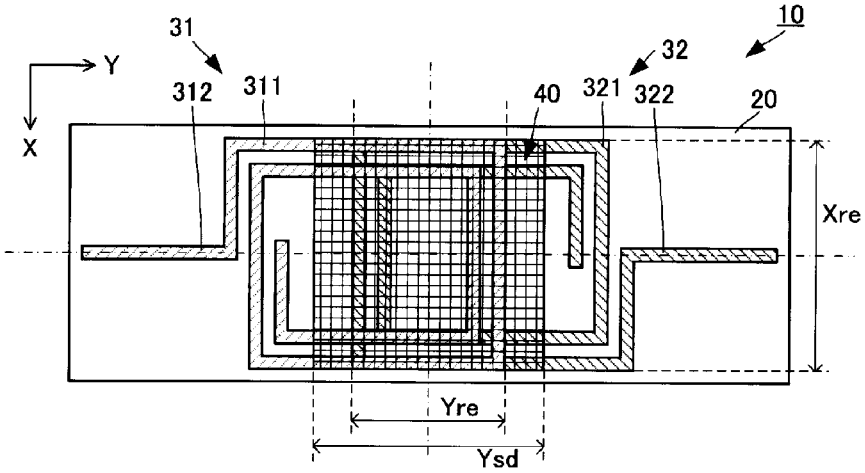
FIGS. 2A-2C include a transparent plan view of the multilayer coil device according to the first preferred embodiment of the present invention, a first side cross-sectional view thereof, and a second side cross-sectional view thereof.
Figure 2B:
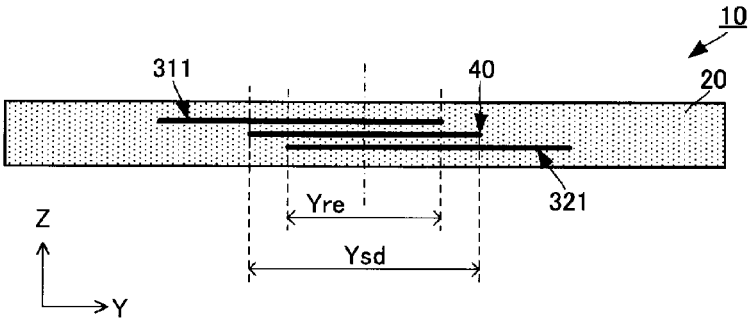
Figure 2C:
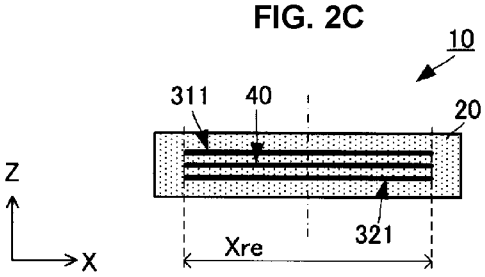
Figure 3A:
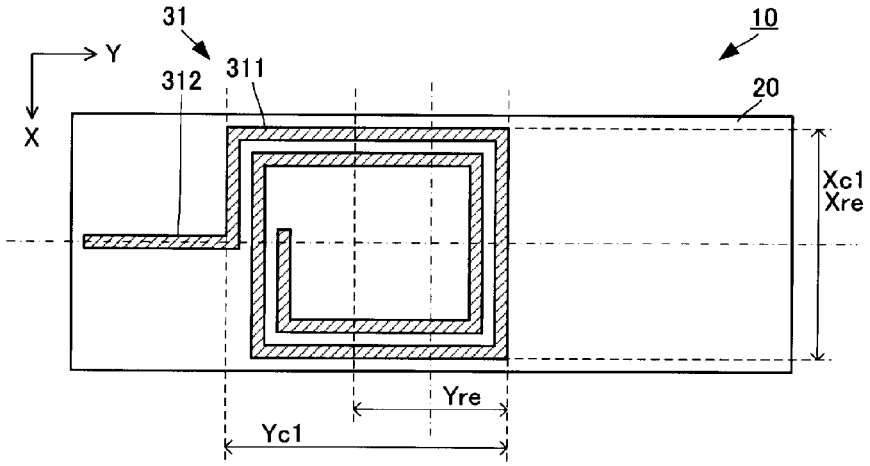
FIGS. 3A-3C include illustrations of schematic conductive patterns in the multilayer coil device according to the first preferred embodiment of the present invention.
Figure 3B:
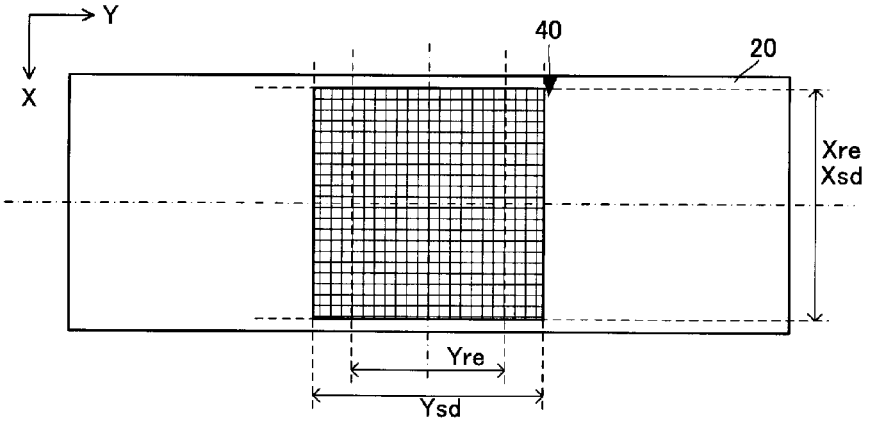
Figure 3C:
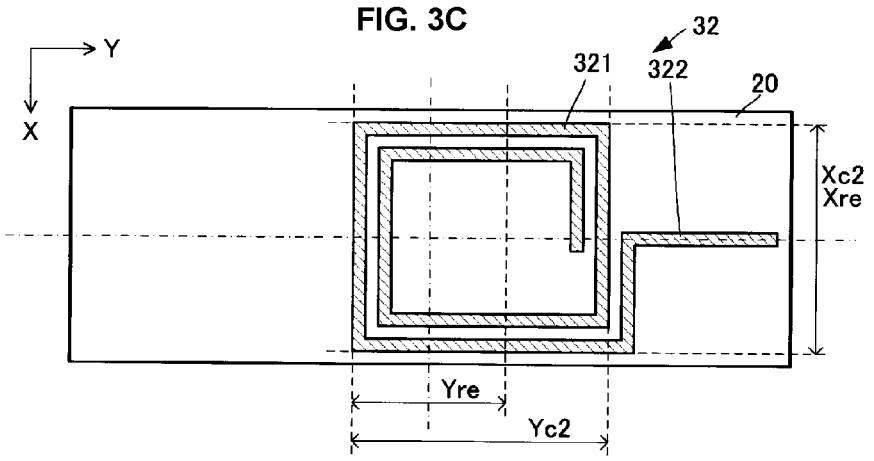

A multilayer coil device according to a first preferred embodiment of the present invention is described with reference to the drawings. FIG. 1 is an external perspective view of the multilayer coil device according to the first preferred embodiment of the present invention. FIG. 2A is a transparent plan view of the multilayer coil device according to the first preferred embodiment of the present invention. FIG. 2B is a first side cross-sectional view of the multilayer coil device according to the first preferred embodiment of the present invention. FIG. 2C is a second side cross-sectional view of the multilayer coil device according to the first preferred embodiment of the present invention. FIGS. 3A-3C include illustrations of schematic conductive patterns in the multilayer coil device according to the first preferred embodiment of the present invention.

A multilayer coil device 10 according to the first preferred embodiment includes a multilayer body 20, as illustrated in FIGS. 1 and 2A-2C. The multilayer body 20 preferably has a rectangular or substantially rectangular parallelepiped shape. The multilayer body 20 is a lamination of a plurality of insulating sheets. The insulating sheets preferably are magnetic ceramic layers, such as ferrite layers. That is, the multilayer body 20 is a magnetic ceramic multilayer body.

The multilayer body 20 includes a first linear conductor 31, a second linear conductor 32, and a magnetic shield member 40 disposed therein. The first linear conductor 31, second linear conductor 32, and magnetic shield member 40 are made of a material having high conductivity, such as silver (Ag). The insulating sheets may also include non-magnetic layers, such as liquid crystal polymer layers, and the various conductive patterns may also be made of copper (Cu).

The first linear conductor 31 includes a first coil conductor 311 with a two-dimensional spiral shape and a first wiring conductor 312. The first coil conductor 311 corresponds to a first coil conductor defining a "first coil", disposed inside the multilayer body, and having a winding shape. The first wiring conductor 312 is connected to an outer end portion of the first coil conductor 311. The first linear conductor 31 is disposed inside the multilayer body 20 such that the first wiring conductor 312 is arranged in the vicinity of one end in a first direction (Y direction in the drawings) when the multilayer body 20 is seen in plan view and the first coil conductor 311 is arranged in the vicinity of the center in the first direction.

The second linear conductor 32 includes a second coil conductor 321 with a two-dimensional spiral shape and a second wiring conductor 322. The second coil conductor 321 corresponds to a second coil conductor defining a "second coil", disposed inside the multilayer body, and having a winding shape. The second wiring conductor 322 is connected to an outer end portion of the second coil conductor 321. The second linear conductor 32 is disposed inside the multilayer body 20 such that the second wiring conductor 322 is arranged in the vicinity of another end in the first direction when the multilayer body 20 is seen in plan view and the second coil conductor 321 is arranged in the vicinity of the center in the first direction.

The magnetic shield member 40 includes a rectangular or substantially rectangular planar conductor. The magnetic shield member 40 is arranged in the vicinity of the center in the first direction when the multilayer body 20 is seen in plan view.

The first linear conductor 31 and second linear conductor 32 are arranged such that their respective planar surfaces are parallel or substantially parallel to each other. In other words, the first coil conductor 311 and second coil conductor 321 are arranged such that their respective winding axes extend in the same or substantially the same direction (parallel or substantially parallel directions). The first linear conductor 31 and second linear conductor 32 are arranged such that they are spaced apart from each other along the thickness direction (laminating direction) of the multilayer body 20. In other words, the first linear conductor 31 and second linear conductor 32 are arranged such that they are spaced apart from each other along the direction in which the winding axes of the first coil conductor 311 and second coil conductor 321 extend. The magnetic shield member 40 is arranged between the first linear conductor 31 and second linear conductor 32 along the thickness direction of the multilayer body 20 (along the direction in which the winding axes of the first coil conductor 311 and second coil conductor 321 extend). The magnetic shield member 40 is arranged such that its planar surfaces are perpendicular or substantially perpendicular to the winding axes of the first and second coil conductors 311 and 321.

In the state where the multilayer body 20 is seen in plan view, in other words, when it is seen in the direction in which the winding axes of the first coil conductor 311 and second coil conductor 321 extend, a region where the first coil conductor 311 is disposed in the first linear conductor 31 (first coil region) and a region where the second coil conductor 321 is disposed in the second linear conductor 32 (second coil region) are arranged such that both regions partially overlap each other. The region of overlap between the region where the first coil conductor 311 is disposed (first coil region) and the region where the second coil conductor 321 is disposed (second coil region) corresponds to a "first region". With this configuration, the planar area of the multilayer body 20 is decreased, in comparison with a structure in which the two coil regions do not overlap each other.

In the state where the multilayer body 20 is seen in plan view, the magnetic shield member 40 is arranged so as to overlap the region of overlap between the region where the first coil conductor 311 is disposed and the region where the second coil conductor 321 is disposed (overlapping region (first region)). In other words, the region where the magnetic shield member 40 is arranged in the state where the multilayer body 20 is seen in plan view contains the region of overlap between the region where the first coil conductor 311 is disposed and the region where the second coil conductor 321 is disposed (overlapping region (first region)).

A more specific example is illustrated in FIGS. 3A-3C. In this example, a length Ysd of the magnetic shield member 40 in the first direction is longer than a length Yre of the overlapping region in which the region where the first coil conductor 311 is disposed and the region where the second coil conductor 321 is disposed overlap each other in the first direction. The positions of the opposite ends of the overlapping region in the first direction are nearer the center along the first direction than positions of the opposite ends of the magnetic shield member 40 in the first direction. A length Xsd of the magnetic shield member 40 in a second direction is the same as a length Xc1 of the region where the first coil conductor 311 is disposed and a length Xc2 of the region where the second coil conductor 321 is disposed in the second direction. That is, the length Xsd of the magnetic shield member 40 in the second direction is the same as a length Xre of the overlapping region in the second direction. The positions of the opposite ends of each of the region where the first coil conductor 311 is disposed and the region where the second coil conductor 321 is disposed in the second direction are the same as the positions of the opposite ends of the magnetic shield member 40 in the second direction.

With this configuration, in the overlapping region where the first coil conductor 311 and second coil conductor 321 are most likely to electromagnetically couple to each other, the electromagnetic coupling between the first coil conductor 311 and second coil conductor 321 is effectively reduced.

Additionally, as illustrated in FIGS. 2A-2C, when the multilayer body 20 is seen in plan view, the magnetic shield member 40 does not overlap a portion of a region that does not overlap the region where the second coil conductor 321 is disposed in the region where the first coil conductor 311 is disposed (non-overlapping region (corresponding to a "second region" in the present invention)). When the multilayer body 20 is seen in plan view, the magnetic shield member 40 does not overlap a portion of a region that does not overlap the region where the first coil conductor 311 is disposed in the region where the second coil conductor 321 is disposed (non-overlapping region (second region)).

The inclusion of the regions of non-overlapping described above reduces the overcurrent occurring in the magnetic shield member 40 when a high frequency signal passes through the first coil conductor 311 and second coil conductor 321. This increases the Q values of the first coil conductor 311 and second coil conductor 321, and thus improves the characteristics of the first and second coil conductors 311 and 321.

Figure 4:
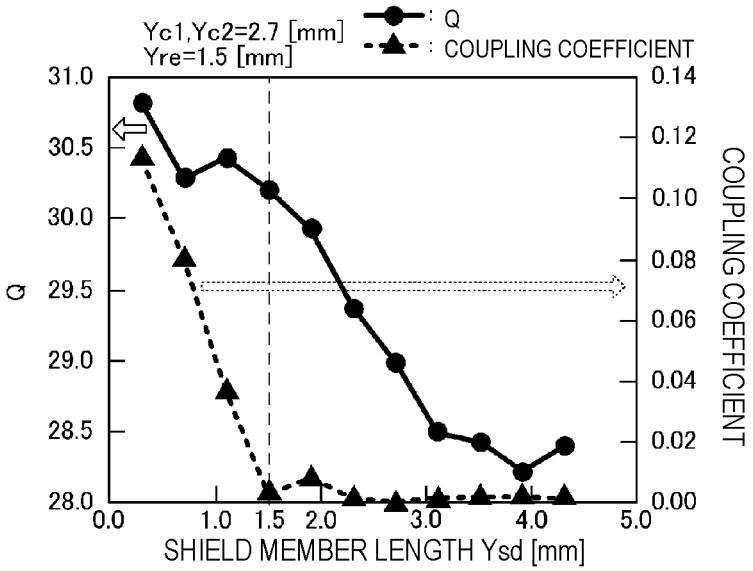
FIG. 4 is a graph that illustrates effects of the degree of overlap between a magnetic shield member and each of an overlapping region and a non-overlapping region on characteristics of coil conductors according to the first preferred embodiment of the present invention.

FIG. 4 is a graph that illustrates effects of the degree of overlap between the magnetic shield member and each of the overlapping region and non-overlapping region on the characteristics of the coil conductors. FIG. 4 is a graph that illustrates the Q value and the coupling coefficient between the first coil conductor 311 and second coil conductor 321 when the area of the region where the first coil conductor 311 is disposed and the area of the region where the second coil conductor 321 is disposed are fixed (length Yre in the first direction=about 1.5 mm), the area of the overlapping region is fixed (lengths Yc1 and Yc2 in the first direction=about 2.7 mm), and the area of the magnetic shield member 40 is changed. The area of the magnetic shield member 40 is changed by changing the length Ysd of the magnetic shield member 40 in the first direction. The position of the center of the magnetic shield member 40 and the position of the center of the overlapping region along the first direction are the same as each other.

As illustrated in FIG. 4, as the length Ysd of the magnetic shield member 40 becomes longer, the Q values of the first and second coil conductors 311 and 321 become lower (more degraded). Accordingly, in terms of solely the Q values, the length Ysd of the magnetic shield member 40 may preferably be short.

However, in the range where the length Ysd of the magnetic shield member 40 is below about 1.5 mm, as the length Ysd becomes shorter, the coupling coefficient becomes higher. In the range where the length Ysd of the magnetic shield member 40 is at or above about 1.5 mm, the coupling coefficient is substantially "0."

The results in FIG. 4 reveal that the length Ysd of the magnetic shield member 40 may preferably be at or above about 1.5 mm, and the length Ysd of the magnetic shield member 40 may more preferably be about 1.5 mm, for example. That is, the magnetic shield member 40 may preferably be arranged so as to overlap the overlapping region, and the magnetic shield member 40 may more preferably be arranged so as to overlap only the overlapping region.

Figure 5:
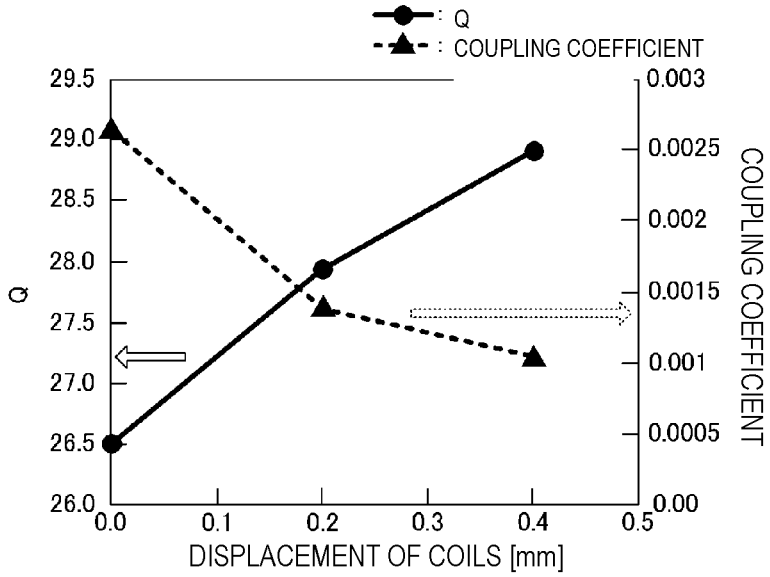
FIG. 5 is a graph that illustrates effects of displacement of overlap between the coil conductors on the characteristics of the coil conductors according to the first preferred embodiment of the present invention.

FIG. 5 is a graph that illustrates effects of displacement of the overlap between the coil conductors on the characteristics of the coil conductors. FIG. 5 illustrates a state where the positional relationship between the first coil conductor 311 and magnetic shield member 40 is fixed and the position of the second coil conductor 321 is displaced along the first direction.

As illustrated in FIG. 5, when the displacement of the coils is increased, that is, when the area where the second coil conductor 321 and magnetic shield member 40 overlap each other is decreased, the Q value of the second wiring conductor 322 is increased and the coupling coefficient to the first coil conductor 311 is decreased. Accordingly, the size of the non-overlapping region may preferably be increased. However, if the size of the non-overlapping region is increased, the area of the multilayer body 20 is increased. Therefore, the displacement may be set at a proper value depending on the product specification, required Q value and coupling coefficient, and allowable size of the multilayer coil device 10.

As described above, when the configuration in the present preferred embodiment is used, the multilayer coil device including the plurality of coils inside the multilayer body and reducing the coupling between the coils is able to be disposed in a small area.

Figure 6:
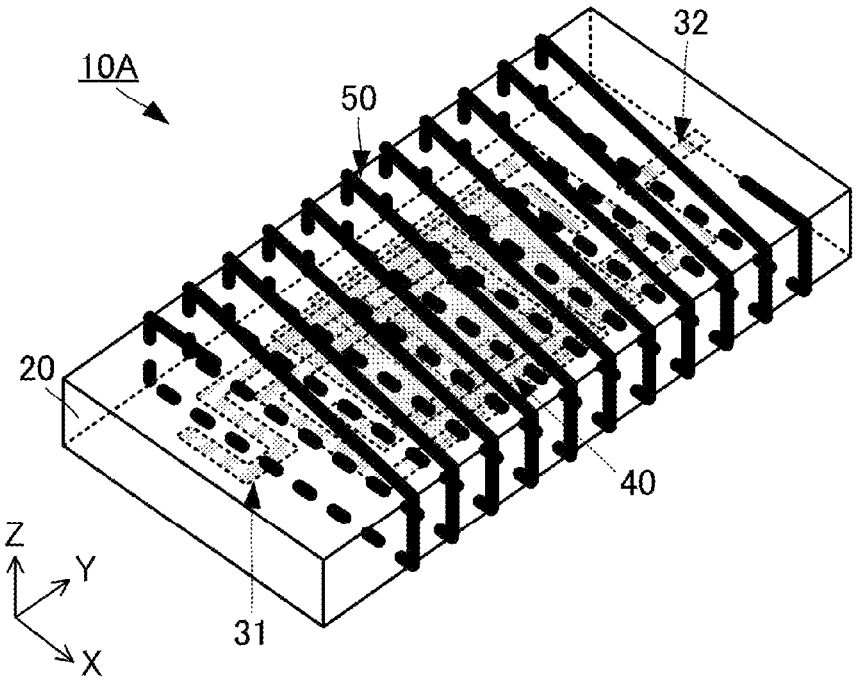
FIG. 6 is an external perspective view of a multilayer coil device according to a second preferred embodiment of the present invention.
Figure 7:
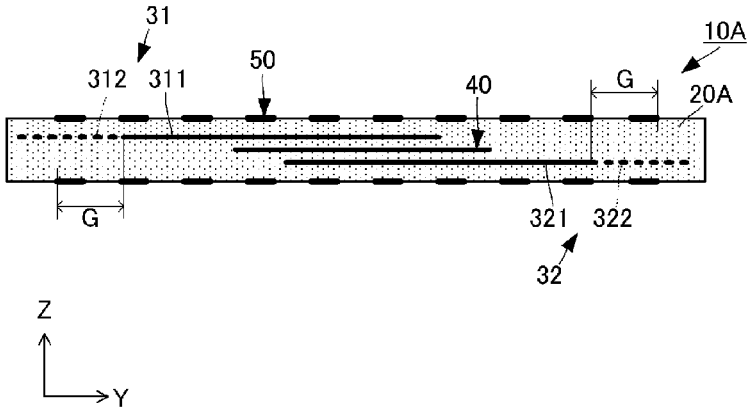
FIG. 7 is a first side cross-sectional view of the multilayer coil device according to the second preferred embodiment of the present invention.

Next, a multilayer coil device according to a second preferred embodiment of the present invention is described with reference to the drawings. FIG. 6 is an external perspective view of the multilayer coil device according to the second preferred embodiment of the present invention. FIG. 7 is a first side cross-sectional view of the multilayer coil device according to the second preferred embodiment of the present invention.

As illustrated in FIGS. 6 and 7, a multilayer coil device 10A according to the second preferred embodiment is one in which a third coil conductor 50 is added to the multilayer coil device 10 illustrated in the first preferred embodiment. The third coil conductor 50 corresponds to a third coil conductor defining a "third coil".

The third coil conductor 50 includes a helical linear conductor winding along four surfaces of a multilayer body 20A. Accordingly, the first and second coil conductors 311 and 321 are arranged in a region surrounded by the helical conductive pattern of the third coil conductor 50. The winding axis of the third coil conductor 50 is perpendicular or substantially perpendicular to the winding axes of the first and second coil conductors 311 and 321.

With this configuration, the multilayer coil device 10A including the first, second, and third conductors 311, 321, and 50 is able to be small in size.

Moreover, in the configuration in the present preferred embodiment, because the winding axis of the third coil conductor 50 is perpendicular or substantially perpendicular to the winding axes of the first and second coil conductors 311 and 321, the electromagnetic coupling between the third coil conductor 50 and the first and second coil conductors 311 and 321 is reduced. That is, the three coil conductors whose mutual induction is reduced are able to be small in size due to the use of the single multilayer body 20A.

As illustrated in FIG. 7, the first and second coil conductors 311 and 321 are disposed in positions spaced apart by a distance G from the opposite ends of the third coil conductor 50 in the first direction, that is, in a region near the center in the first direction.

Figure 8:
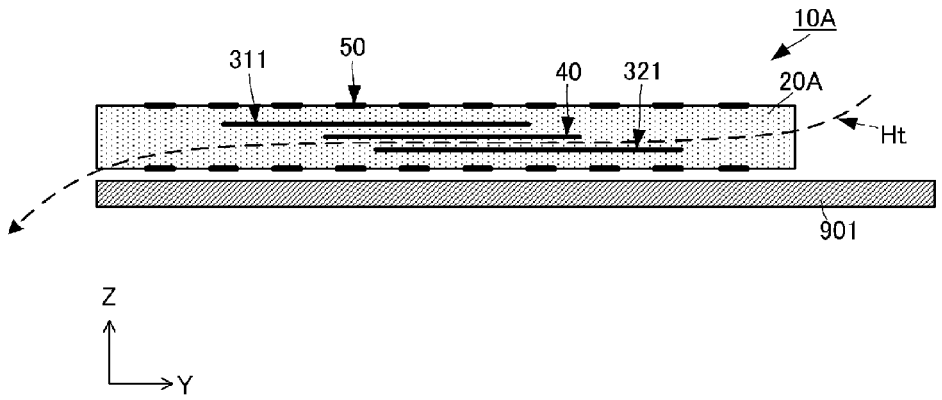
FIG. 8 illustrates an externally applied magnetic field Ht coupled to a third coil conductor.

With this configuration, the coupling of the first and second coil conductors 311 and 321 to an externally applied magnetic field to which the third coil conductor 50 is coupled is able to be reduced. FIG. 8 illustrates an externally applied magnetic field Ht coupled to the third coil conductor. As illustrated in FIG. 8, the multilayer coil device 10A is mounted on a surface of a base substrate 901 defining an electronic device module including the multilayer coil device 10A. In this case, as illustrated in FIG. 8, a line of magnetic force in the externally applied magnetic field Ht does not pass through the base substrate 901. Thus, the direction of the line of magnetic force in the externally applied magnetic field Ht is parallel or substantially parallel to the planar surfaces of the first and second coil conductors 311 and 321. Accordingly, the coupling between the externally applied magnetic field and the first and second coil conductors 311 and 321 is reduced by the adoption of the configuration illustrated in FIG. 7.

Additionally, as illustrated in FIG. 8, the line of magnetic force in the externally applied magnetic field Ht defines an angle that is not 0° with respect to (extends in a direction that crosses) a plane parallel or substantially parallel to the planar surfaces of the first and second coil conductors 311 and 321 in the vicinity of the opposite ends of the third coil conductor 50 in the first direction (direction along the winding axis). Accordingly, in comparison with the case where the first and second coil conductors 311 and 321 are arranged in the vicinity of the opposite ends of the third coil conductor 50 in the first direction (direction along the winding axis), the coupling between the externally applied magnetic field and the first and second coil conductors 311 and 321 is further reduced in the configuration in the present preferred embodiment.

Figure 9:
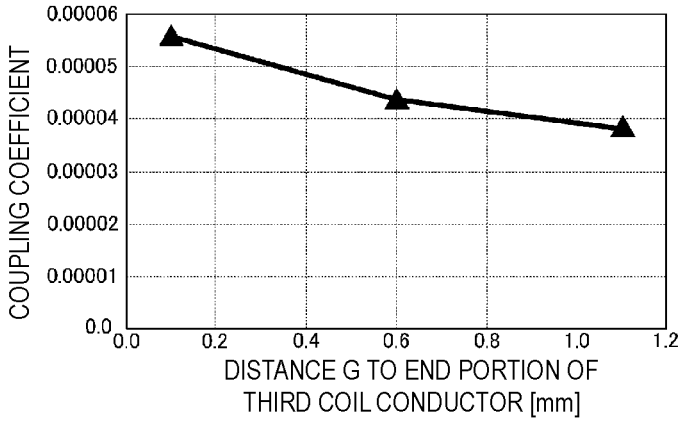
FIG. 9 is a graph that illustrates effects of the distance of an end portion of the third coil conductor and each of first and second coil conductors on a coupling coefficient.

FIG. 9 is a graph that illustrates effects of the distance between the end portion of the third coil conductor and the first and second coil conductors on the coupling coefficient. As illustrated in FIG. 9, the coupling of the first and second coil conductors to the externally applied magnetic field is able to be still further reduced by increasing the distance G between the end portion of the third coil conductor and the first and second coil conductors.

Figure 10:
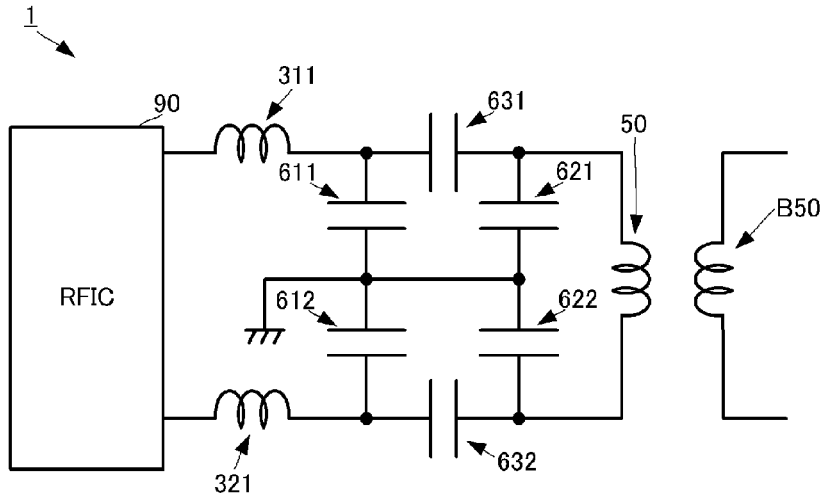
FIG. 10 is a circuit diagram that illustrates a portion of a wireless communication system including an antenna module according to a preferred embodiment of the present invention.
Figure 11A:
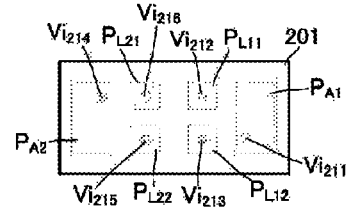
FIGS. 11A-11K include plan views of layers included in a multilayer coil device according to a third preferred embodiment of the present invention.
Figure 11B:
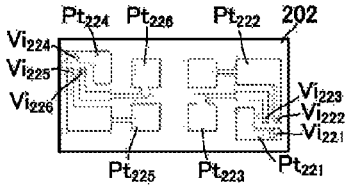
Figure 11C:
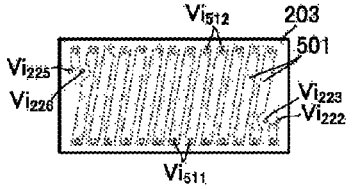
Figure 11D:
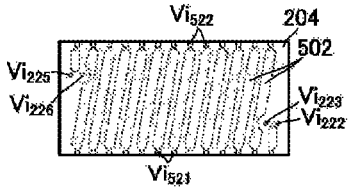
Figure 11E:
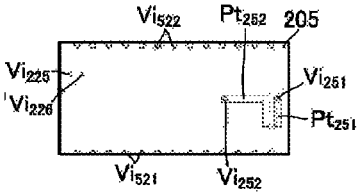
Figure 11F:
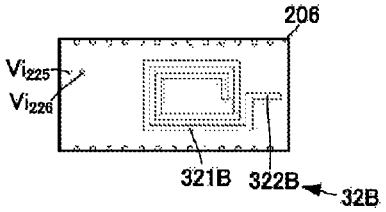
Figure 11F:
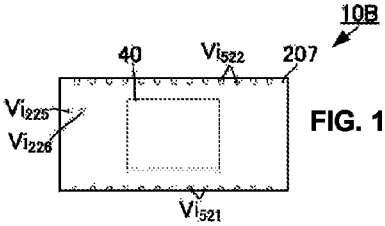
Figure 11G:
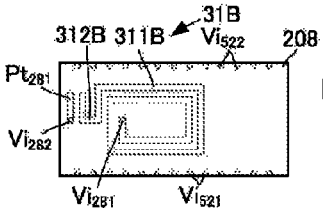
Figure 11H:
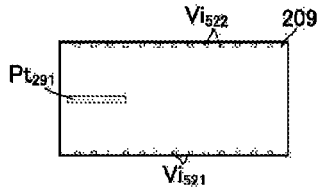
Figure 11I:
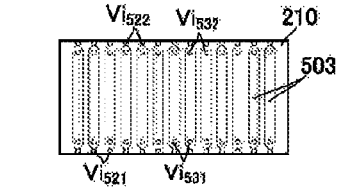
Figure 11J:
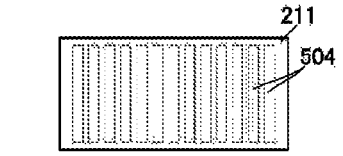
Figure 11K:
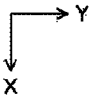
Figure 12A:
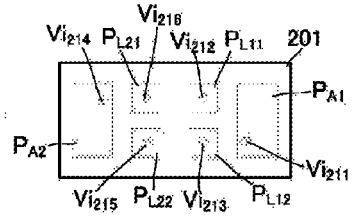
FIGS. 12A-12I include plan views of layers included in a multilayer coil device according to a fourth preferred embodiment of the present invention.
Figure 12B:
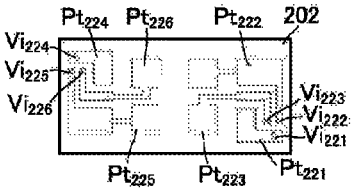
Figure 12C:
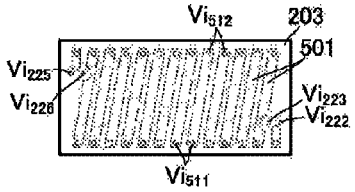
Figure 12D:
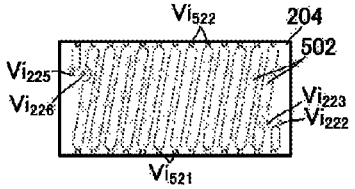
Figure 12E:
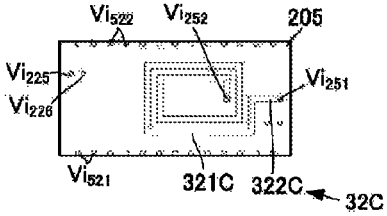
Figure 12F:
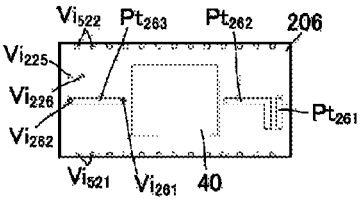
Figure 12G:
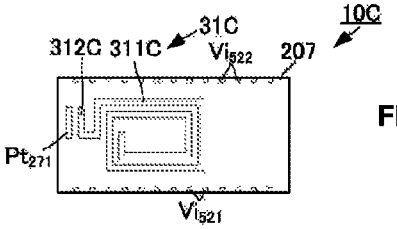
Figure 12H:
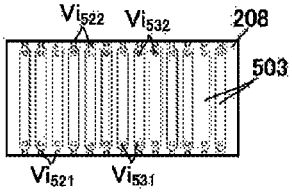
Figure 12I:
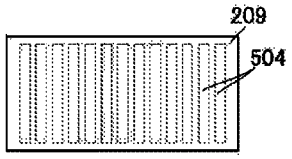
Figure 12I:
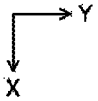
Figure 13A:
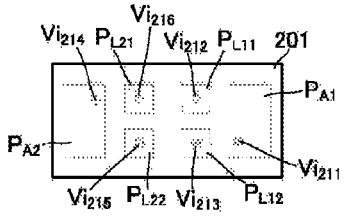
FIGS. 13A-13I include plan views of layers included in a multilayer coil device according to a fifth preferred embodiment of the present invention.
Figure 13B:
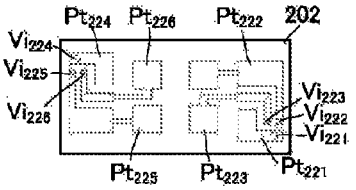
Figure 13C:
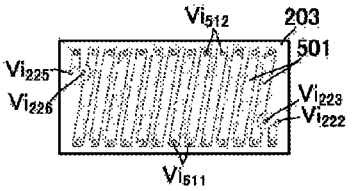
Figure 13D:
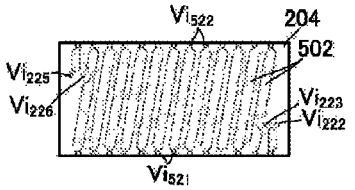
Figure 13E:
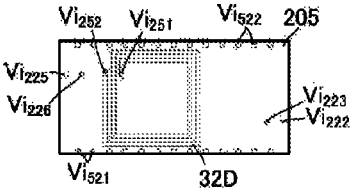
Figure 13F:
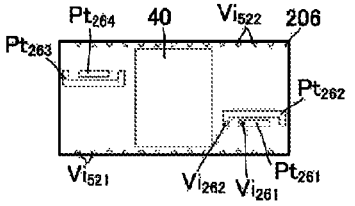
Figure 13G:
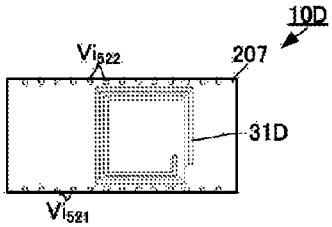
Figure 13H:
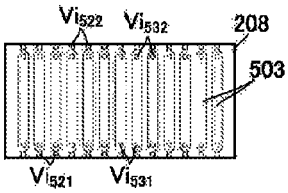
Figure 13I:
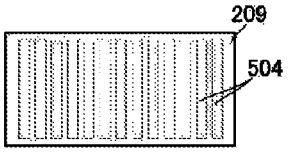
Figure 13I:
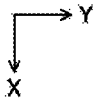
Figure 14A:
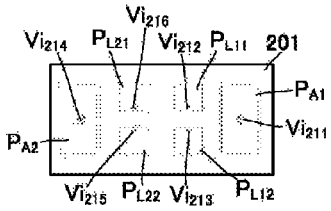
FIGS. 14A-14I include plan views of layers included in a multilayer coil device according to a sixth preferred embodiment of the present invention.
Figure 14B:
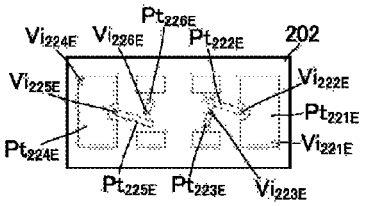
Figure 14C:
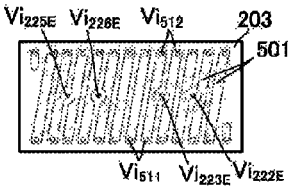
Figure 14D:
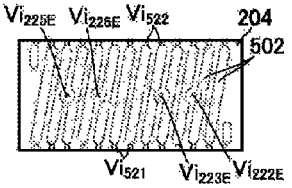
Figure 14E:
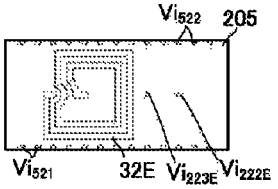
Figure 14F:
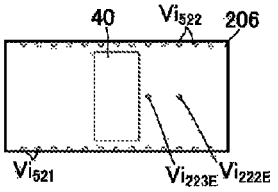
Figure 14F:
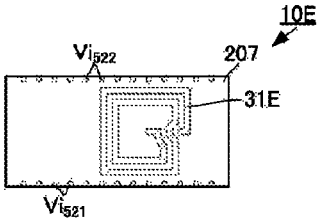
Figure 14G:
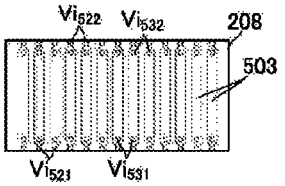
Figure 14H:
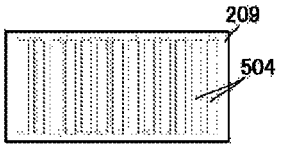
Figure 14I:
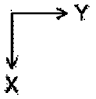
Figure 15A:
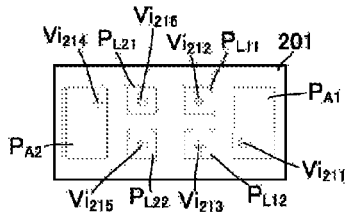
FIGS. 15A-15I include plan views of layers included in a multilayer coil device according to a seventh preferred embodiment of the present invention.
Figure 15B:
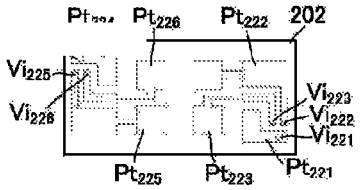
Figure 15C:
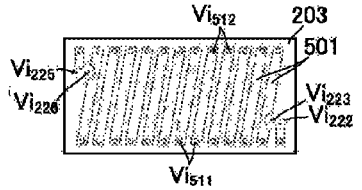
Figure 15D:
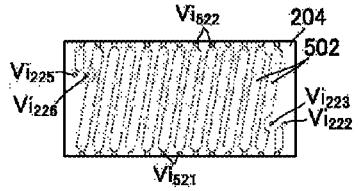
Figure 15E:
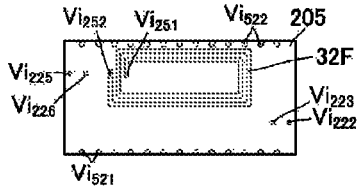
Figure 15F:
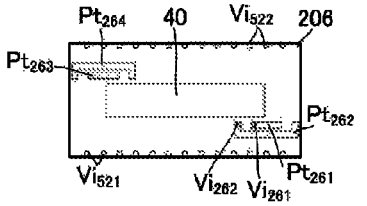
Figure 15G:
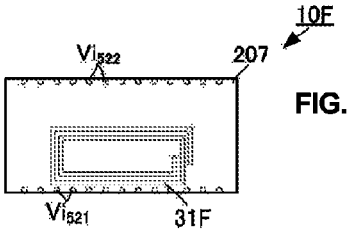
Figure 15H:
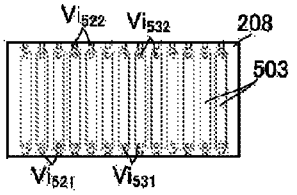
Figure 15I:
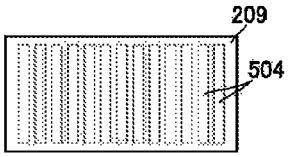
Figure 15I:
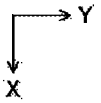

The multilayer coil device 10A having the above-described configuration is preferably included in an antenna module illustrated in FIG. 10. FIG. 10 is a circuit diagram that illustrates a portion of a wireless communication system including the antenna module according to a preferred embodiment of the present invention.

The wireless communication system includes an antenna module 1 and a feed-side antenna coil B50. The antenna module 1 includes inductors including the first coil conductor 311 and second coil conductor 321, respectively, an antenna coil including the third coil conductor 50, capacitors 611, 612, 621, 622, 631, and 632, and an RFIC 90. The antenna module 1 establishes wireless communications by bringing the antenna coil including the third coil conductor 50 near to the feed-side antenna coil B50.

The RFIC 90 includes a first terminal connected to one end of the antenna coil including the third coil conductor 50 with the inductor including the first coil conductor 311 and capacitor 631 interposed therebetween. The RFIC 90 includes a second terminal connected to another end of the antenna coil including the third coil conductor 50 with the inductor including the second coil conductor 321 and capacitor 632 interposed therebetween.

The node between the first coil conductor 311 and capacitor 631 is connected to one end of the capacitor 611. The node between the second coil conductor 321 and capacitor 632 is connected to one end of the capacitor 612. The other ends of the capacitors 611 and 612 are connected to the ground.

The node between the third coil conductor 50 and capacitor 631 is connected to one end of the capacitor 621. The node between the third coil conductor 50 and capacitor 632 is connected to one end of the capacitor 622. The other ends of the capacitors 621 and 622 are connected to the ground.

The circuit including the capacitors 621, 622, 631, and 632 defines a matching circuit for the antenna coil including the third coil conductor 50 and the RFIC 90. The circuit including the inductors defined by the first coil conductor 311 and second coil conductor 321 and the capacitors 611 and 612 defines an EMC filter circuit.

The use of the above-described multilayer coil device 10A in the antenna module 1 makes the antenna module 1 more compact and thinner.

The present preferred embodiment illustrates an example that uses the multilayer coil device 10A including the third coil conductor 50. A configuration in which the multilayer coil device 10 according to the first preferred embodiment is used and an additional antenna coil is used may also be used. In this case, the multilayer coil device 10 corresponds to a "wireless communication module". With this configuration, the wireless communication module is also made more compact and thinner.

Next, a multilayer coil device according to a third preferred embodiment of the present invention is described with reference to the drawing. FIGS. 11A-11K include plan views of layers included in the multilayer coil device according to the third preferred embodiment of the present invention.

A multilayer coil device 10B according to the present preferred embodiment is a lamination of insulating layers 201 to 211 described below. The insulating layers 201, 202, 203, 210, and 211 are made of a non-magnetic insulating material. The insulating layers 204 to 209 are made of a magnetic material.

Various land conductors for external connection are disposed on the surface of the insulating layer 201. Specifically, antenna-coil land conductors $P_{A1}$ and $P_{A2}$ and inductor land conductors $P_{L11}$, $P_{L12}$, $PL_{21}$, and $PL_{A1}$ are disposed on the insulating layer 201. The antenna-coil land conductor $P_{A1}$ is disposed in the vicinity of one end of the insulating layer 201 in the longitudinal direction (Y direction). The antenna-coil land conductor $P_{A2}$ is disposed in the vicinity of another end of the insulating layer 201 in the longitudinal direction (Y direction).

The inductor land conductors $P_{L11}$, $P_{L12}$, $PL_{21}$, and $P_{L22}$ are arranged between the antenna-coil land conductors $P_{A1}$ and $P_{A2}$ along the longitudinal direction (Y direction). The inductor land conductors $P_{L11}$ and $P_{L12}$ are near the antenna-coil land conductor $P_{A1}$. The inductor land conductors $P_{L21}$ and $P_{L22}$ are near the antenna-coil land conductor $P_{A2}$. The inductor land conductors $P_{L11}$ and $P_{L21}$ are arranged along the longitudinal direction (Y direction). The inductor land conductors $P_{L12}$ and $P_{L22}$ are arranged along the longitudinal direction (Y direction).

Wiring conductors $Pt_{221}$, $Pt_{222}$, $Pt_{223}$, $Pt_{224}$, $Pt_{225}$, and $Pt_{226}$ are disposed on the surface of the insulating layer 202.

The wiring conductor $Pt_{221}$ has one end connected to the antenna-coil land conductor $P_{A1}$ with a via conductor $Vi_{211}$ in the insulating layer 201 interposed therebetween. The wiring conductor $Pt_{221}$ has another end connected to a coil conductor 501 on one end of the insulating layer 203 in the longitudinal direction (Y direction) with a via conductor $Vi_{221}$ in the insulating layer 202 interposed therebetween.

The wiring conductor $Pt_{222}$ has one end connected to the inductor land conductor $P_{L11}$ with a via conductor $Vi_{212}$ in the insulating layer 201 interposed therebetween. The wiring conductor $Pt_{222}$ has another end connected to one end of a wiring conductor $Pt_{251}$ on the insulating layer 205 with a via conductor $Vi_{222}$ in the insulating layers 202, 203, and 204 interposed therebetween.

The wiring conductor $Pt_{223}$ has one end connected to the inductor land conductor $P_{L2}$ with a via conductor $Vi_{213}$ in the insulating layer 201 interposed therebetween. The wiring conductor $Pt_{223}$ has another end connected to one end of a wiring conductor $Pt_{252}$ on the insulating layer 205 with a via conductor $Vi_{223}$ in the insulating layers 202, 203, and 204 interposed therebetween.

The via conductors $Vi_{22+2}$ and $Vi_{223}$ are arranged in the vicinity of one end in the insulating layers 202, 203, and 204 in the longitudinal direction. The arrangement of the via conductors $Vi_{22+2}$ and $Vi_{223}$ in the longitudinal direction in the insulating layers reduces the coupling to the externally applied magnetic field to which an antenna coil conductor described below is coupled.

The wiring conductor $Pt_{224}$ has one end connected to the antenna-coil land conductor $P_{A2}$ with a via conductor $Vi_{214}$ in the insulating layer 201 interposed therebetween. The wiring conductor $Pt_{224}$ has another end connected to a coil conductor 501 on another end of the insulating layer 203 in the longitudinal direction (Y direction) with a via conductor $Vi_{224}$ in the insulating layer 202 interposed therebetween.

The wiring conductor $Pt_{225}$ has one end connected to the inductor land conductor $P_{L22}$ with a via conductor $Vi_{215}$ in the insulating layer 201 interposed therebetween. The wiring conductor $Pt_{225}$ has another end connected to one end of a wiring conductor $Pt_{281}$ in the insulating layer 208 with a via conductor $Vi_{225}$ in the insulating layers 202, 203, 204, 205, 206, and 207 interposed therebetween.

The wiring conductor $Pt_{226}$ has one end connected to the inductor land conductor $P_{L21}$ with a via conductor $Vi_{216}$ in the insulating layer 201 interposed therebetween. The wiring conductor $Pt_{226}$ has another end connected to one end of a first wiring conductor 312B in the insulating layer 208 with a via conductor $Vi_{226}$ in the insulating layers 202, 203, 204, 205, 206, and 207 interposed therebetween.

The via conductors $Vi_{225}$ and $Vi_{226}$ are arranged in the longitudinal direction in the vicinity of another end in the insulating layers 202, 203, 204, 205, 206, and 207. The arrangement of the via conductors $Vi_{225}$ and $Vi_{226}$ in the longitudinal direction of the insulating layers reduce the coupling to the externally applied magnetic field to which the antenna coil conductor described below is coupled.

The plurality of coil conductors 501 are disposed on the surface of the insulating layer 203. The plurality of coil conductors 501 are linear conductors extending in parallel or substantially in parallel to the widthwise direction (X direction) of the insulating layer 203. The plurality of coil conductors 501 are arranged at intervals along the longitudinal direction of the insulating layer 203.

A plurality of coil conductors 502 are disposed on the surface of the insulating layer 204. The plurality of coil conductors 502 are linear conductors extending in parallel or substantially in parallel to the widthwise direction (X direction) of the insulating layer 204. The plurality of coil conductors 502 are arranged at intervals along the longitudinal direction of the insulating layer 204. The coil conductors 502 are arranged in positions overlapping the coil conductors 501 disposed on the insulating layer 203 when the multilayer coil device 10B is seen in plan view. One end of each of the coil conductors 502 is connected to one end of the corresponding coil conductor 501 with a corresponding via conductor $Vi_{511}$ in the insulating layer 203 interposed therebetween. The end of each of the coil conductors 502 is connected to one end of a corresponding coil conductor 503 on the insulating layer 210 with a corresponding via conductor $Vi_{521}$ in a groove in a side surface of each of the insulating layers 204, 205, 206, 207, and 208 interposed therebetween.

Another end of each of the coil conductors 502 is connected to another end of the corresponding coil conductor 501 with a corresponding via conductor $Vi_{512}$ in the insulating layer 203 interposed therebetween. The other end of each of the coil conductors 502 is connected to the other end of the corresponding coil conductor 503 on the insulating layer 210 with a corresponding via conductor $Vi_{522}$ in a groove in a side surface of each of the insulating layers 204, 205, 206, 207, and 208 interposed therebetween.

The wiring conductors $Pt_{251}$ and $Pt_{252}$ are disposed on the surface of the insulating layer 205.

A second coil conductor 321B and second wiring conductor 322B are disposed on the surface of the insulating layer 206. The second coil conductor 321B has a spiral shape and has an outer end connected to the second wiring conductor 322B. The second coil conductor 321B has an inner end connected to the wiring conductor Pt252 on the insulating layer 205 with a via conductor $Vi_{252}$ in the insulating layer 205 interposed therebetween. An end in the second wiring conductor 322B opposite an end connected to the second coil conductor 321B is connected to the wiring conductor $Pt_{251}$ on the insulating layer 205 with a via conductor $Vi_{251}$ in the insulating layer 205 interposed therebetween.

The planar magnetic shield member 40 is disposed on the surface of the insulating layer 207. The magnetic shield member 40 overlaps at least a region in which a region where the second coil conductor 321B is disposed in the insulating layer 206 and a region where a first coil conductor 311B is disposed in the insulating layer 208 overlap each other. Additionally, the magnetic shield member 40 does not overlap at least a portion of a region in which the region where the second coil conductor 321B is disposed in the insulating layer 206 and the region where the first coil conductor 311B is disposed in the insulating layer 208 do not overlap each other. In these circumstances, the magnetic shield member 40 may have a shape that overlaps only the region in which the region where the second coil conductor 321B is disposed in the insulating layer 206 and the region where the first coil conductor 311B is disposed in the insulating layer 208 overlap each other.

The first coil conductor 311B, first wiring conductor 312B, and wiring conductor $Pt_{281}$ are disposed on the surface of the insulating layer 208. The first coil conductor 311B has a spiral shape and has an outer end connected to the first wiring conductor 312B. The first coil conductor 311B has an inner end connected to a wiring conductor $Pt_{291}$ on the insulating layer 209 with a via conductor $Vi_{281}$ in the insulating layer 208 interposed therebetween. An end in the first wiring conductor 312B opposite an end connected to the first coil conductor 311B is connected to the above-described via conductor $Vi_{225}$.

The wiring conductor $Pt_{281}$ has one end connected to the above-described via conductor $Vi_{226}$. The wiring conductor $Pt_{281}$ has another end connected to the wiring conductor $Pt_{291}$ on the insulating layer 209 with a via conductor $Vi_{282}$ in the insulating layer 208 interposed therebetween.

The wiring conductor $Pt_{291}$ is disposed on the insulating layer 209.

The plurality of coil conductors 503 are disposed on the surface of the insulating layer 210. The plurality of coil conductors 503 are linear conductors extending in parallel or substantially in parallel to the widthwise direction (X direction) of the insulating layer 210. The plurality of coil conductors 503 are arranged at intervals along the longitudinal direction of the insulating layer 210. One end of each of the coil conductors 503 is connected to the corresponding via conductor $Vi_{521}$ described above. Another end of each of the coil conductors 503 is connected to the corresponding via conductor $Vi_{522}$ described above.

A plurality of coil conductors 504 are disposed on the surface of the insulating layer 211. The plurality of coil conductors 504 are linear conductors extending in parallel or substantially in parallel to the widthwise direction (X direction) of the insulating layer 211. The plurality of coil conductors 504 are arranged at intervals along the longitudinal direction of the insulating layer 211. The coil conductors 504 are arranged in positions overlapping the coil conductors 503 disposed on the insulating layer 210 when the multilayer coil device 10B is seen in plan view. One end of each of the coil conductors 504 is connected to one end of the corresponding coil conductor 503 with a corresponding via conductor $Vi_{531}$ in the insulating layer 210 interposed therebetween. Another end of each of the coil conductors 504 is connected to another end of the corresponding coil conductor 503 on the insulating layer 210 with a corresponding via conductor $Vi_{532}$ in the insulating layer 210 interposed therebetween.

With this configuration, the multilayer coil device 10B having substantially the same operational advantages as those in the above-described second preferred embodiment is provided. Moreover, in the configuration in the present preferred embodiment, a portion surrounded by the helical conductor of the third coil conductor including the coil conductors 501, 502, 503, and 504 and the via conductors $Vi_{511}$, $Vi_{512}$, $Vi_{521}$, $Vi_{522}$, $Vi_{531}$, and $Vi_{532}$ is able to be magnetic. This leads to improved antenna characteristics when the third coil conductor is used as the antenna coil.

In the present preferred embodiment, with the combination of the coil conductors 501 and 502 and the via conductors $Vi_{511}$ and $Vi_{512}$ and the combination of the coil conductors 503 and 504 and the via conductors $Vi_{531}$ and $Vi_{532}$, the resistivity of the coils is reduced. This leads to a further improved Q value of the third coil conductor.

The use of the above-described structure of the via conductors $Vi_{223}$, $Vi_{224}$, $Vi_{226}$, and $Vi_{226}$ reduces the coupling between these via conductors and the externally applied magnetic field and leads to further improved antenna characteristics.

In the configuration in the present preferred embodiment, the third coil conductor does not protrude from the external shape of the multilayer body and is not exposed in the planar surface. With this, unnecessary electromagnetic coupling to an external environment is reduced, and tolerance to the external environment is improved.

Next, a multilayer coil device according to a fourth preferred embodiment of the present invention is described with reference to the drawing. FIGS. 12A-12I include plan views of layers included in the multilayer coil device according to the fourth preferred embodiment of the present invention.

A multilayer coil device 10C in the present preferred embodiment is one in which the multilayer coil device 10B illustrated in the third preferred embodiment has a reduced number of insulating layers. The sections different from the multilayer coil device 10B illustrated in the third preferred embodiment are specifically described below.

The multilayer coil device 10C includes wiring conductors $Pt_{261}$, $Pt_{262}$, and $Pt_{263}$ for a first coil conductor 311C and a second coil conductor 321C on the insulating layer 206 where the magnetic shield member 40 is disposed. That is, the multilayer coil device 10C has a configuration in which the magnetic field member and the wiring conductors for the coil conductors are disposed on the same layer.

With this configuration, the multilayer coil device 10C obtains substantially the same operational advantages as those in the multilayer coil device 10B according to the third preferred embodiment. Additionally, the configuration of the multilayer coil device 10C makes the multilayer coil device thinner.

Next, a multilayer coil device according to a fifth preferred embodiment of the present invention is described with reference to the drawing. FIGS. 13A-13I include plan views of layers included in the multilayer coil device according to the fifth preferred embodiment of the present invention.

A multilayer coil device 10D in the present preferred embodiment is one in which the multilayer coil device 10C illustrated in the fourth preferred embodiment has different wiring patterns. The sections different from the multilayer coil device 10C illustrated in the fourth preferred embodiment are specifically described below.

The multilayer coil device 10D in the present preferred embodiment has a configuration in which no wiring conductors are disposed on the insulating layer 207 where a first linear conductor 31D defined by only the first coil conductor is disposed and on the insulating layer 205 where a second linear conductor 32D defined by only the second coil conductor is disposed.

With this configuration, substantially the same operational advantages as those in the multilayer coil device 10C according to the fourth preferred embodiment are also obtainable.

Next, a multilayer coil device according to a sixth preferred embodiment of the present invention is described with reference to the drawing. FIGS. 14A-14I include plan views of layers included in the multilayer coil device according to the sixth preferred embodiment of the present invention.

A multilayer coil device 10E in the present preferred embodiment is one in which the multilayer coil device 10D illustrated in the fifth preferred embodiment has different wiring patterns. The sections different from the multilayer coil device 10D illustrated in the fifth preferred embodiment are specifically described below.

In the multilayer coil device 10E in the present preferred embodiment, the opposite ends of a second coil conductor 32E on the insulating layer 205 and the opposite ends of a first coil conductor 31E on the insulating layer 207 are connected to the wiring conductors disposed on the insulating layer 202, which is a wiring layer, by only the via conductors $Vi_{222E}$, $Vi_{223E}$, $Vi_{225E}$, and $Vi_{226E}$. In addition, wiring conductors $Pt_{222E}$, $Pt_{223E}$, $Pt_{224E}$, $Pt_{225E}$, and $Pt_{226E}$ disposed on the insulating layer 202 are linear.

With this configuration, the sizes of the regions of the conductors overlapping in the laminating direction are reduced. This leads to a reduced stray capacitance resulting from the overlapping conductors and improves the characteristics as the coil.

Next, a multilayer coil device according to a seventh preferred embodiment of the present invention is described with reference to the drawing. FIGS. 15A-15I include plan views of layers included in the multilayer coil device according to the seventh preferred embodiment of the present invention.

A multilayer coil device 10F in the present preferred embodiment is one in which the multilayer coil device 10D illustrated in the fifth preferred embodiment has different wiring patterns. The sections different from the multilayer coil device 10D illustrated in the fifth preferred embodiment are specifically described below.

In the above-described preferred embodiments, the first coil conductor is arranged on one end side with respect to the center of the multilayer body in the longitudinal direction (Y direction), and the second coil conductor is arranged on another end side thereof. The multilayer coil device 10F in the present preferred embodiment has a configuration in which a first linear conductor 31F defined by only the first coil conductor is arranged on one end side with respect to the center of the multilayer body in the widthwise direction (X direction), and a second linear conductor 32F defined by only the second coil conductor is arranged on another end side thereof.

With this configuration, substantially the same operational advantages as those in the multilayer coil device 10D according to the fifth preferred embodiment are also obtainable.

Figure 16:
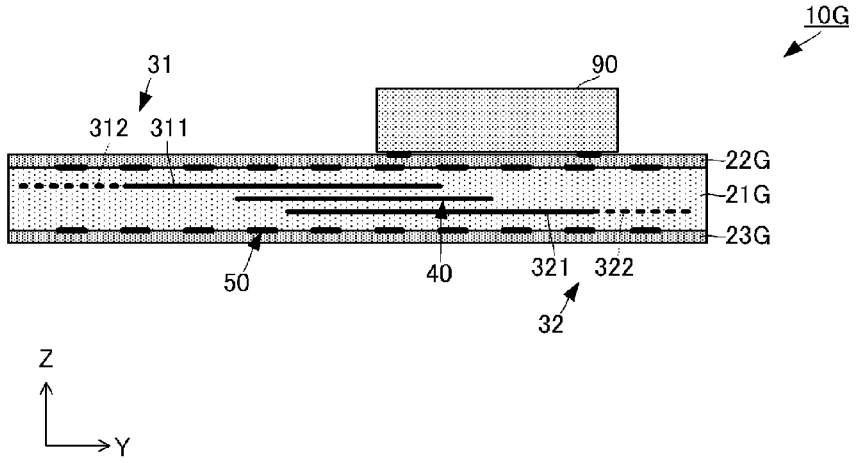
FIG. 16 is a side cross-sectional view of a multilayer coil device according to an eighth preferred embodiment of the present invention.

Next, a multilayer coil device according to an eighth preferred embodiment of the present invention is described with reference to the drawing. FIG. 16 is a side cross-sectional view of the multilayer coil device according to the eighth preferred embodiment of the present invention.

A multilayer coil device 10G in the present preferred embodiment is one in which the RFIC 90 is mounted on any one of the multilayer coil devices 10B to 10F according to the above-described third to seventh preferred embodiments. The multilayer coil device 10G has a structure in which a magnetic layer 21G is disposed between non-magnetic layers 22G and 23G. Land conductors that mount the RFIC 90 are disposed on the surface of the non-magnetic layer 22G in the multilayer body and connected to other conductors in the multilayer body.

With this configuration, the system is able to be more miniaturized than that when the elements are separately mounted on a circuit board. The present preferred embodiment illustrates an example in which the RFIC 90 is mounted on the multilayer body. Another circuit element, for example, a passive component, such as a capacitor, resistor, or inductor, or an active component may also be mounted.

Figure 17:
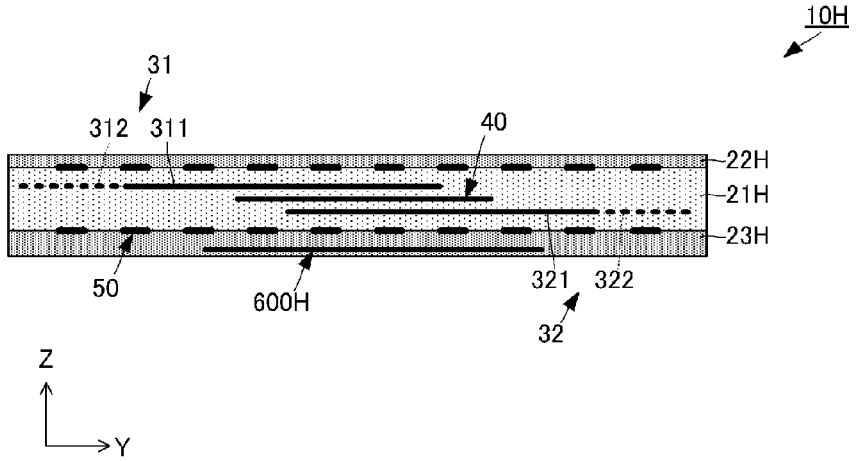
FIG. 17 is a side cross-sectional view of a multilayer coil device according to a ninth preferred embodiment of the present invention.

Next, a multilayer coil device according to a ninth preferred embodiment of the present invention is described with reference to the drawing. FIG. 17 is a side cross-sectional view of the multilayer coil device according to the ninth preferred embodiment of the present invention.

A multilayer coil device 10H in the present preferred embodiment is one in which an internal ground conductor 600H is added to any one of the multilayer coil devices 10B to 10F according to the above-described third to seventh preferred embodiments. The multilayer coil device 10H has a structure in which a magnetic layer 21H is disposed between non-magnetic layers 22H and 23H. The internal ground conductor 600H is a planar conductor and is disposed outside the helix of the third coil conductor and inside the non-magnetic layer 23H.

Figure 18:
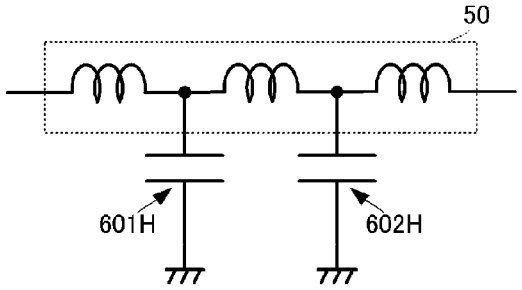
FIG. 18 is a circuit diagram of an antenna coil in the multilayer coil device according to the ninth preferred embodiment of the present invention.

With this configuration, a circuit described below is achievable. FIG. 18 is a circuit diagram of an antenna coil in the multilayer coil device according to the ninth preferred embodiment of the present invention.

The third coil conductor 50 defining an antenna coil includes a plurality of inductor portions. The nodes between the inductors are connected to the ground by capacitors 601H and 602H, respectively. The capacitors 601H and 602H are achievable by using the above-described internal ground conductor 600H and a coil conductor for the third coil conductor 50 near it.

With this configuration, an antenna coil having the filter function, more specifically, an antenna coil having the low pass filter function is achievable.

Figure 19:
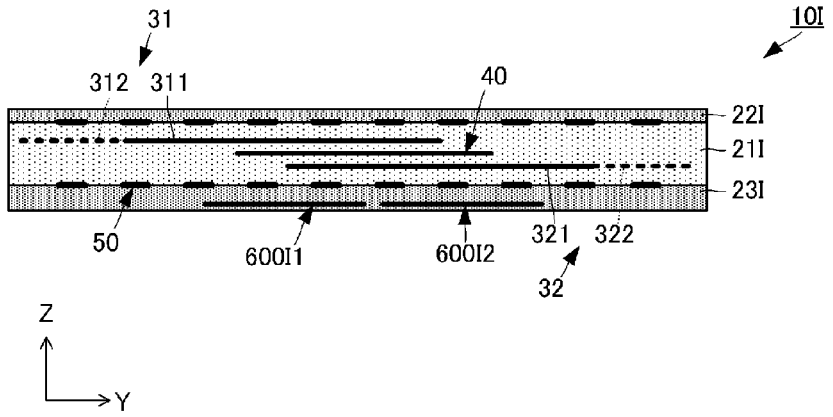
FIG. 19 is a side cross-sectional view of a multilayer coil device according to a tenth preferred embodiment of the present invention.

Next, a multilayer coil device according to a tenth preferred embodiment of the present invention is described with reference to the drawing. FIG. 19 is a side cross-sectional view of the multilayer coil device according to the tenth preferred embodiment of the present invention.

A multilayer coil device 101 in the present preferred embodiment includes an internal ground conductor having a different shape from that in the multilayer coil device 10H according to the above-described ninth preferred embodiment. The multilayer coil device 101 has a structure in which a magnetic layer 21I is disposed between non-magnetic layers 22I and 23I. Internal ground conductors 600I1 and 600I2 are planar conductors and are disposed outside the helix of the third coil conductor and inside the non-magnetic layer 23I.

With this configuration, an antenna coil having the filter function is achievable, as in the multilayer coil device 10H illustrated in the ninth preferred embodiment. In addition, in the configuration in the present preferred embodiment, the capacitance of a capacitor connected to the ground is able to be set at a desired value by arranging the plurality of internal ground conductors. This achieves desired filter characteristics more accurately.

Figure 20:
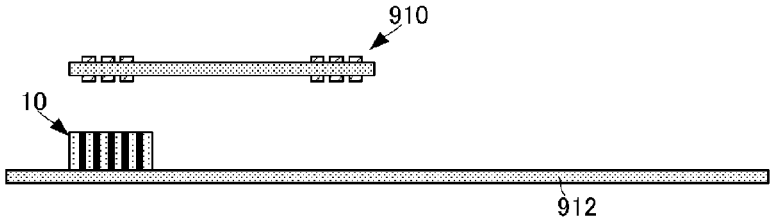
FIG. 20 is a side view of an antenna module according to an eleventh preferred embodiment of the present invention.

Next, a multilayer coil device according to an eleventh preferred embodiment of the present invention is described with reference to the drawing. FIG. 20 is a side view of an antenna module according to the eleventh preferred embodiment of the present invention.

The antenna module according to the present preferred embodiment includes the multilayer coil device 10, a booster antenna 910, and a base substrate 912.

The multilayer coil device 10 is arranged on the base substrate 912. The booster antenna 910 is arranged near the surface of the base substrate 912 on which the multilayer coil device 10 is mounted. The booster antenna 910 is spaced apart from the base substrate 912.

In this way, the multilayer coil devices illustrated in the above-described preferred embodiments can be used as a feed coil in the antenna module including the booster antenna 910.

A structure in which the booster antenna 910 is not used and the base substrate 912 is used as a radiation planar conductor may also be used.

Figure 21A:
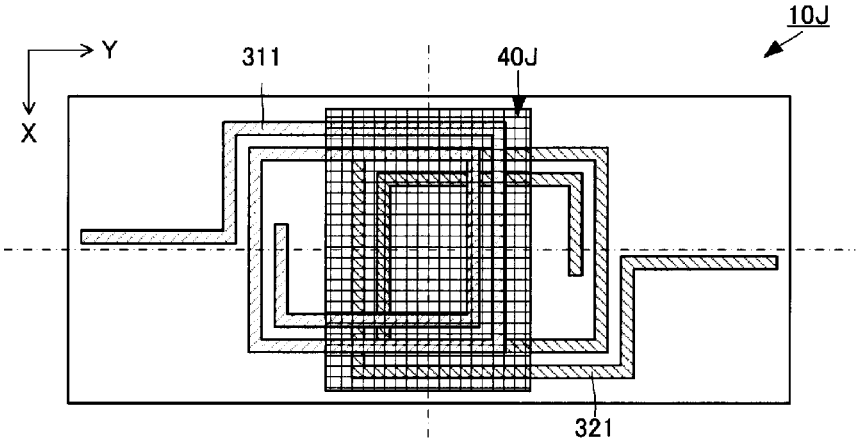
FIGS. 21A-21B include plan views that illustrate other structures of the first coil conductor, second coil conductor, and magnetic shield.
Figure 21B:
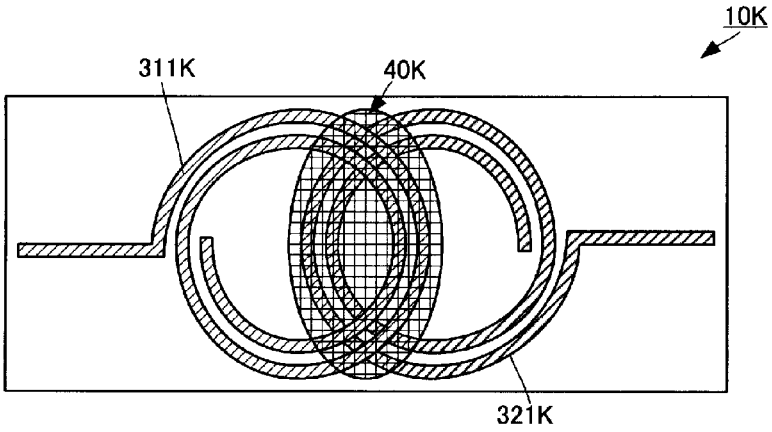

The first coil conductor, second coil conductor, and magnetic shield member may have the structures described below. FIGS. 21A-21B include plan views that illustrate other structures of the first coil conductor, second coil conductor, and magnetic shield in the present invention.

In the structure illustrated in FIG. 21A, the first coil conductor 311 and second coil conductor 321 are arranged in positions displaced in both the longitudinal direction and widthwise direction. In this structure, a magnetic shield member 40J may be arranged in the region in which the region where the first coil conductor 311 is disposed and the region where the second coil conductor 321 is disposed overlap each other.

In the structure illustrated in FIG. 21B, each of a first coil conductor 311K and a second coil conductor 321K has a circular spiral shape as seen in plan view. In this configuration, a magnetic shield member 40K may be arranged in the region in which the region where the first coil conductor 311K is disposed and the region where the second coil conductor 321K is disposed overlap each other. The circular shape in FIG. 21B may be replaced with another polygonal shape.

The above-described preferred embodiments illustrate examples in which each of the first coil conductor and second coil conductor is disposed on a single layer. With a structure in which at least one of the first and second coil conductors includes a winding linear conductor disposed on a plurality of layers, the above-described operational advantages are also obtainable.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A multilayer coil device comprising:

a multilayer body in which a plurality of insulating sheets are laminated;

a first coil conductor and a second coil conductor defining a first coil and a second coil, respectively, disposed inside the multilayer body and each having a winding shape; and a magnetic shield member disposed inside the multilayer body and having a two-dimensional shape; wherein respective winding axes of the first coil and the second coil extend in a same or substantially a same direction and respective winding regions of the first coil and the second coil partially overlap each other as seen in the direction in which the winding axes extend; and the magnetic shield member is located between the first coil and the second coil in the direction in which the winding axes extend and overlaps a first region where the first coil and the second coil overlap each other and does not overlap at least a portion of a second region where the first coil and the second coil do not overlap each other, as seen in the direction in which the winding axes extend.

2. The multilayer coil device according to claim 1, wherein the direction in which the winding axes of the first coil and the second coil extend is identical or substantially identical with a direction in which the plurality of insulating sheets are laminated.

3. The multilayer coil device according to claim 1, further comprising a third coil including a third coil conductor disposed in the multilayer body and having a helical shape; wherein the first coil, the second coil, and the magnetic shield member are arranged inside a region surrounded by the helical shape of the third coil.

4. The multilayer coil device according to claim 3, wherein the winding axes of the first coil and the second coil are perpendicular or substantially perpendicular to a winding axis of the third coil.

5. The multilayer coil device according to claim 3, wherein the first coil and the second coil are located in an inward region spaced apart by a predetermined distance from opposite ends of the third coil in a direction in which the winding axis of the third coil extends.

6. The multilayer coil device according to claim 3, wherein at least portions of the insulating sheets defining the multilayer body are magnetic, and the first coil and the second coil are located between the magnetic insulating sheets.

7. The multilayer coil device according to claim 3, further comprising a plurality of via conductors for use in connecting the first coil, the second coil, and the third coil to an external terminal; wherein a direction in which the plurality of via conductors are arranged is parallel or substantially parallel to the direction in which the winding axis of the third coil extends.

8. The multilayer coil device according to claim 3, wherein the third coil defines a coil antenna; and the first coil and the second coil define inductors included in a circuit connected to the coil antenna.

9. The multilayer coil device according to claim 1, wherein the magnetic shield member surrounds only the first region.

10. An antenna module comprising:

multilayer coil device according to claim 8; and a wireless IC connected to at least one of the inductors defined by the first coil and the second coil.

11. The antenna module according to claim 10, wherein the direction in which the winding axes of the first coil and the second coil extend is identical or substantially identical with a direction in which the plurality of insulating sheets are laminated.

12. The antenna module according to claim 10, wherein the winding axes of the first coil and the second coil are perpendicular or substantially perpendicular to a winding axis of the third coil.

13. The antenna module according to claim 10, wherein the first coil and the second coil are located in an inward region spaced apart by a predetermined distance from opposite ends of the third coil in a direction in which the winding axis of the third coil extends.

14. The antenna module according to claim 10, wherein at least portions of the insulating sheets defining the multilayer body are magnetic, and the first coil and the second coil are located between the magnetic insulating sheets.

15. The antenna module according to claim 10, further comprising a plurality of via conductors for use in connecting the first coil, the second coil, and the third coil to an external terminal; wherein a direction in which the plurality of via conductors are arranged is parallel or substantially parallel to the direction in which the winding axis of the third coil extends.

16. The antenna module according to claim 10, wherein the magnetic shield member surrounds only the first region.

17. A wireless communication module comprising:

multilayer coil device according to claim 8; and a wireless IC connected to the inductors defined by the first coil and the second coil; wherein the first coil and the second coil define a filter circuit; and the coil antenna defined by the third coil is connected to the wireless IC with the filter circuit interposed therebetween and defines a radiating element.

18. The wireless communication module according to claim 17, wherein the direction in which the winding axes of the first coil and the second coil extend is identical or substantially identical with a direction in which the plurality of insulating sheets are laminated.

19. The wireless communication module according to claim 17, wherein the winding axes of the first coil and the second coil are perpendicular or substantially perpendicular to a winding axis of the third coil.

20. The wireless communication module according to claim 17, wherein the first coil and the second coil are located in an inward region spaced apart by a predetermined distance from opposite ends of the third coil in a direction in which the winding axis of the third coil extends.

* * * * *